United States Patent [19]

Müller

[11] 4,208,014

[45] Jun. 17, 1980

[54] FUEL INJECTOR FOR INTERNAL COMBUSTION ENGINES

[75] Inventor: Eckart Müller, Schwabach, Fed. Rep. of Germany

[73] Assignee: Maschinenfabrik Augsburg-Nünberg Aktiengesellschaft, Nuremberg, Fed. Rep. of Germany

[21] Appl. No.: 950,584

[22] Filed: Oct. 12, 1978

[30] Foreign Application Priority Data

Oct. 13, 1977 [DE] Fed. Rep. of Germany ..... 2746010

[51] Int. Cl.[2] ..... F02M 61/04

[52] U.S. Cl. ..... 239/533.4

[58] Field of Search ..... 239/533.2–533.12

[56] References Cited

U.S. PATENT DOCUMENTS 2,470,717 5/1949 Palumbo ..... 239/533.8

FOREIGN PATENT DOCUMENTS 324405 1/1935 Italy ..... 239/533.4

551282 11/1956 Italy ..... 239/533.4

*Primary Examiner*—Andres Kashnikow

*Attorney, Agent, or Firm*—Becker & Becker, Inc.

[57] ABSTRACT

A fuel injector for internal combustion engines in which an axially slidable nozzle needle is provided which is capable of being lifted off its seat by the pressure of the fuel against the thrust of one or a plurality of springs and is formed with a pointed tip below the valve seat with at least one spray hole being provided in the nozzle body at an acute angle relative to the nozzle axis. The tip of the nozzle needle is shaped and enters the spray hole or injection bore in such a way that the free cross-sectional area at the injection bore is less than the free cross-sectional area at the seat in nearly all positions of the nozzle needle.

2 Claims, 1 Drawing Figure

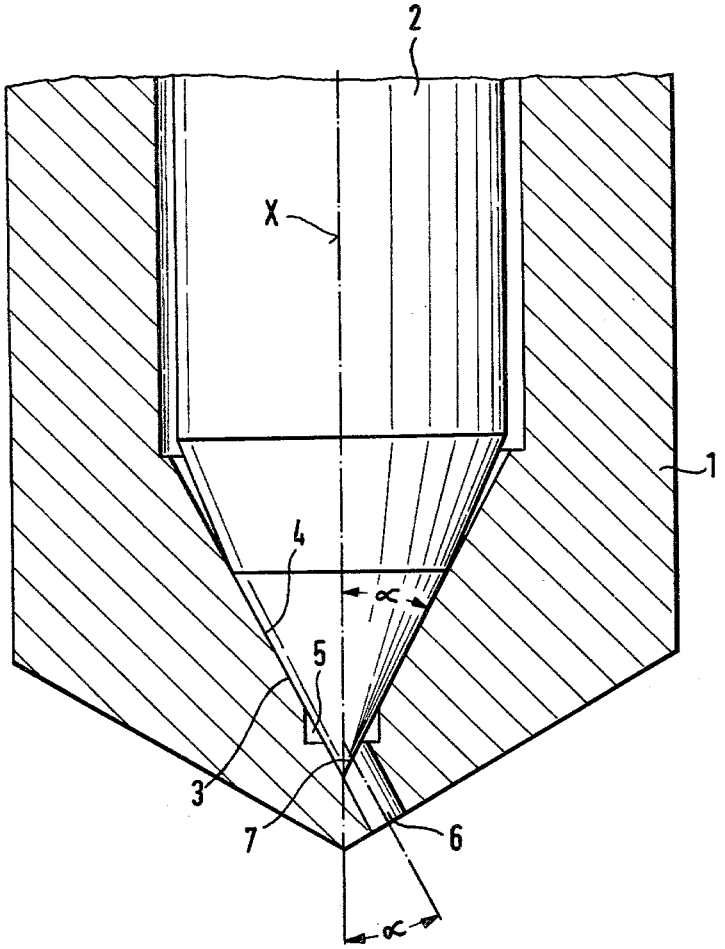
2
X
1
4
α
5
3
7
6
α

FUEL INJECTOR FOR INTERNAL COMBUSTION ENGINES

This invention relates to a fuel injector for internal combustion engines which has a nozzle needle axially slidable and adapted to be lifted off its seat by the pressure of the fuel against the thrust of one or a plurality of springs, the nozzle needle having a pointed tip below the seat, and at least one spray hole being provided in the nozzle body and disposed at an acute angle to the nozzle axis.

An injector of this general type is disclosed in British Pat. No. 565,299. The injector described therein has a fuel collecting chamber provided below the valve seat. In the closed position of the nozzle needle, the pointed tip of the nozzle needle penetrates into that fuel collecting chamber into which lead spray holes having stepped diameters and being exactly defined both in respect of their length and their diameters.

It is an established fact that the quality of fuel injection in internal combustion engines is substantially dependent on the respective prevailing injection pressure. If, in the above described injector, the nozzle needle is lifted only slightly, there will, on the one hand, in view of the narrow gap in the valve seat, occur a marked reduction in fuel pressure, and, on the other hand, the full area of all spray holes will be instantly uncovered. This leads to conditions where, in particular during the opening and closing phases of the nozzle needle, only a greatly reduced pressure is available at the spray holes for injection. The consequences are poor mixture preparation and combustion resulting in reduced exhaust gas quality and increased fuel consumption. This applies especially to the lower speed and load ranges of an engine in which a large part, or even the complete injection process, takes place during the opening and closing phases of the nozzle needle.

It is here where the invention starts which has for its object to improve a fuel injector of the general type described above and to do so by simple means and without any additional cost so as to ensure that the fuel pressure is available substantially undiminished throughout the whole injection process.

This object and other objects and advantages of the invention will appear more clearly from the following specification in connection with the accompanying drawing diagrammatically illustrating partly in section and partly in view the lower part of a fuel injector according to the present invention.

The fuel injector according to the present invention is characterized primarily in that the tip of the nozzle needle is so formed and so extends into the spray hole that the free cross-sectional area at the spray hole is in substantially all positions of the nozzle needle less than the respective free cross-sectional area at the valve seat. In other words, simultaneously with the control of the free area at the needle seat, there is, in a simple manner, effected a control of the free area directly at the spray hole. When the nozzle needle rises only slightly from its seat, it is still possible for the full injection pressure to build up in front of the spray hole whereby the desired efficient mixture formation and combustion is ensured in all operating ranges of the engine, in particular, in the lower speed and load ranges.

A further feature of the invention consists in that the angle between the nozzle axis and the spray hole equals the angle between the tip of the nozzle needle and the nozzle axis. This will result in a minimum change in area as the needle lift is varied.

Even when, with the nozzle needle fully opened, its tip no longer enters the spray hole, it is important to see to it that the free area directly at the spray hole is less than that at the valve seat.

Referring now to the drawing in detail, a nozzle body 1 has arranged therein an axially slidable nozzle needle 2 which, with a conical surface 3 contacts a similarly formed valve seat 4 in the nozzle body 1. Below the valve seat, there is provided a fuel collecting space 5 from which a spray hole or injection bore 6 arranged at an acute angle $\alpha$ relative to the nozzle axis x extends for fuel injection. The conical surface 3 of the nozzle needle 2 contacting the valve seat 4 is extended to form a pointed tip 7 which extends into the spray hole 6 and controls its free cross-sectional area as the nozzle needle is lifted. As shown in the drawing, the outer surface of the tip 7 with its conical surface 3 forms an easy to manufacture cone which slants at the same angle $\alpha$ as the spray hole or injection bore 6. It should be mentioned in this connection that the inclination of the tip 7 and, consequently, of the spray hole 6 relative to the nozzle axis x need not necessarily coincide with the inclination of the surface 3 or the valve seat 4.

It is, of course, to be understood that the present invention is, by no means, limited to the specific showing in the drawing but also encompasses any modifications within the scope of the appended claims.

What I claim is:

1. A fuel injector for internal combustion engines, which includes: a nozzle body having a valve bore with a conical valve seat, a nozzle needle having a needle tip and being reciprocably arranged in said valve bore and having a seating surface adapted to sealingly engage said valve seat and to be lifted off said valve seat, said nozzle body being provided with at least one spray hole having its axis define an acute angle with the axis of said valve bore, said spray hole being entered by said needle tip when the seating surface of said nozzle needle engages said valve seat, said tip of said nozzle needle being so shaped and entering said spray hole in such a way that the free cross-sectional area at the spray hole in nearly all positions in which said nozzle needle is lifted off said valve seat is less than the respective free cross-sectional area at said valve seat.

2. A fuel injector according to claim 1, in which the free cross-sectional area at said spray hole with said nozzle needle in fully open position is less than the free cross-sectional area at said valve seat.

* * * * *

UNITED STATES PATENT AND TRADEMARK OFFICE

CERTIFICATE OF CORRECTION

PATENT NO. : 4,208,014

DATED : June 17, 1980

INVENTOR(S) : Eckart Müller

It is certified that error appears in the above—identified patent and that said Letters Patent is hereby corrected as shown below:

(73) Assignee should read: -- Maschinenfabrik Augsburg- Nürnberg Aktiengesellschaft, Nürnberg, Feb. Rep. of Germany --.

Signed and Sealed this

*Nineteenth* Day of *August 1980*

[SEAL]

*Attest:*

SIDNEY A. DIAMOND

*Attesting Officer*

*Commissioner of Patents and Trademark*